United States Patent [19]

Stratton et al.

[11] 4,327,306

[45] Apr. 27, 1982

[54] FACE PLATE FOR CATHODE RAY TUBE

[75] Inventors: Roy F. Stratton, Oriskany; Edward J. Calucci, Syracuse, both of N.Y.

[73] Assignee: The United States of America as represented by the Secretary of the Air Force, Washington, D.C.

[21] Appl. No.: 97,596

[22] Filed: Nov. 27, 1979

[51] Int. Cl.[3] ..... H01J 31/02; H01J 29/86

[52] U.S. Cl. ..... 313/419; 313/477 R

[58] Field of Search ..... 313/475, 419, 398, 477

[56] References Cited

U.S. PATENT DOCUMENTS

| | | | |
|---|---|---|---|
| 3,144,650 | 8/1964 | Levine . | |
| 3,210,597 | 10/1965 | Siegmund et al. | 313/419 X |
| 3,333,278 | 7/1967 | Hawkins et al. | 350/96.24 X |
| 3,553,719 | 1/1971 | Miyazaki . | |
| 3,609,233 | 9/1971 | Nagao . | |
| 3,717,531 | 2/1973 | Smith | 350/96.24 X |
| 3,732,367 | 5/1973 | Teranishi et al. . | |
| 3,789,259 | 1/1974 | Allen . | |
| 3,818,131 | 6/1974 | Emmons . | |
| 3,984,842 | 10/1976 | Meltzer et al. . | |
| 3,994,000 | 11/1976 | Trainor et al. | 346/160 |
| 4,026,642 | 5/1977 | Tanaka et al. | 355/1 |

OTHER PUBLICATIONS

"A Fundamental Study of the Electromagnetic Properties of Advanced Composite Materials," by W. J. Gajda, Phase Report RADC-TR-78-158, Jul. 1978, Part (5) Boron Fibers, pp. 19-31.

*Primary Examiner*—Palmer C. Demeo

*Attorney, Agent, or Firm*—Donald J. Singer; William J. O'Brien

[57] ABSTRACT

A cathode ray tube having a face plate composed of a plurality of boron fibers which act as a charge transfer medium to make signals accessible from the outside of the tube for further manipulation and processing.

4 Claims, 1 Drawing Figure

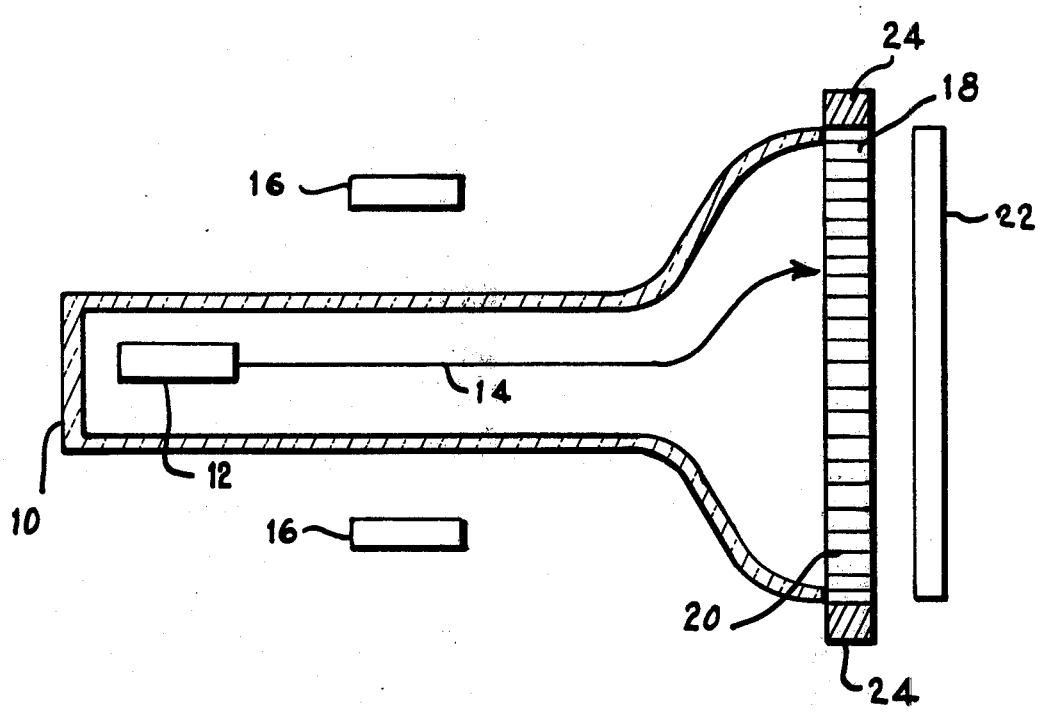
24
18
16
22
14
12
10
16
20
24

FACE PLATE FOR CATHODE RAY TUBE

STATEMENT OF GOVERNMENT INTEREST

The invention described herein may be manufactured and used by or for the Government for governmental purposes without the payment of any royalty thereon.

BACKGROUND OF THE INVENTION

This invention relates to cathode ray tubes and to a faceplate for use therewith. More particularly, this invention concerns itself with a cathode ray tube face plate particularly adapted to bring about charge transfer from the electron beam generated within the tube to any controlled media positioned outside the tube.

A cathode ray tube is an electron tube in which a beam of electrons can be focused on a surface to present information in the form of a pattern of light. The particular pattern is determined by sweeping electrical signals from an electron gun positioned within the body of the tube across the surface of the tube's faceplate. Generally the surface is luminescent and the electrical signals are converted to a predetermined visual pattern. The television picture tube is the most familiar form of the cathode ray tube.

However, other cathode ray tubes are utilized that do not produce a visual pattern but, instead, transmit the electric signal from the electron gun through the face plate of the tube to provide a charge transfer to an ancilliary recording device positioned outside the tube itself. Unfortunately, the tubes designed to accomplish this type of charge transfer do not provide good resolution. With the present invention, however, a cathode ray tube faceplate fabricated from commercially available boron fibers would provide a simple and convenient means for effecting a charge transfer from the electron beam within a cathode ray tube to a controlled media outside while still maintaining a vacuum in the cathode ray tube. In addition, the device of this invention provides high resolution up to about 30,000 dots per square inch ($\sim$170 dots/inch on each axis). The use of the faceplate of this invention would find wide use in electronic printing, optical modulation, projection displays, real time optical processing, memory access, as well as for use in a variety of other electronic devices and applications.

SUMMARY OF THE INVENTION

According to the present invention, a cathode ray tube is provided with a face plate composed of a plurality of boron fibers in a plastic or synthetic resin matrix. An epoxy, polyimide or other similar plastic matrix would be suitable for the matrix component. The fibers are positioned in parallel relationship to one another with the longitudinal axis of each fiber coincident to the longitudinal axis of the cathode ray tube. The boron fibers provide a charge transfer medium for information transfer from the inside of the cathode ray tube, in the form of electric signals generated by the tubes electron gun, to a recording media outside the tube.

Accordingly, the primary object of this invention is to provide a charge transfer medium for a cathode ray tube in order to effect an information transfer from the inside of a cathode ray tube to the outside while still maintaining a vacuum within the tube.

Another object of this invention is to provide a means for enhancing the resolution characteristics of a cathode ray tube.

Still another object of this invention is the utilization of boron fibers in the fabrication of a face plate for a cathode ray tube.

The above and still other objects and advantages of the present invention will become more readily apparent upon consideration of the following detailed description thereof when viewed in conjunction with the accompanying drawing.

BRIEF DESCRIPTION OF THE DRAWING

In the drawing

The FIGURE represents a schematic illustration of a cathode ray tube with the face plate of this invention.

DESCRIPTION OF THE PREFERRED EMBODIMENT

The present invention is predicated upon the discovery that commercially available boron fibers within an epoxy matrix can be used as a structural material in the fabrication of a cathode ray tube faceplate. The resultant tube is capable of high resolution of use to about 30,000 dots per square inch or about 170 dots per inch on each axis. The boron fibers act as a charge transfer medium for transferring information from the electron beam within the tube through the face plate to a controlled recording media or device outside the tube.

In order to further illustrate the invention in greater detail, reference is made to the drawing which illustrates a typical cathode ray tube comprising a glass envelope 10, an electron gun 12 for directing an electron beam 14 against the inside surface of a face plate 18. The beam 14 is deflected by deflecting plates 16 for scanning across the interior surface of faceplate 18. The deflected beam 14 passes through boron fibers 20 which provide the charge transfer medium necessary for transferring the information represented by the electric signal 14 to a conventional recording means 22. A metal supporting ring 24 circumscribes the faceplate 18 to provide compression and hence additional strength and stability for the face plate. Attachment of the face plate 18 is accomplished by affixing it to the glass envelope 10 by means of a conventional epoxy adhesive.

Commercially available boron fibers can be utilized in fabricating the face plate 18. For example, Rigidite 5505 fibers from the Avco Corporation have been found suitable. These fibers consist of a central core of tungsten boride which is relatively conductive (conductivity is about $3\times10^5$ mhos/meter) surrounded by a boron sheath which is a relatively good insulator (conductivity is about 0.25 mhos/meter). Thus, each fiber is essentially an insulated wire about 0.005 inches in diameter overall. It provides an excellent medium for the transfer of electrical charges through the face plate 18 to the exterior recording means 22.

In fabricating the face plate, the boron fibers 20 are oriented so that the fibers carry the electric signal 14 from the inside of the envelope 10 to the outside. Generally, the boron fibers are provided in the form of a boron/epoxy tape with all the fibers in a single layer running parallel to one another in one direction and embedded in a matrix of uncured epoxy. The fibers and epoxy are held together by a thin glass cloth backing which can be removed or allowed to remain in place during construction of the face plate. It is not necessary to remove the backing since it is made of glass and does not interfere with the transfer of the electric signal through the boron fibers 20.

In constructing the face plate 18, its thickness will depend on the strength of the boron/epoxy composite perpendicular to the fibers, and the desired diameter. A thickness of about one inch, however, should prove satisfactory. The boron/epoxy tape can be wound in a spiral until the desired diameter is achieved or the tape can be cut into one inch wide strips with the fibers running across the stip and positioned parallel to each other. As stated heretofore, the strip can be wound into a spiral, or, alternatively, it can be cut into strips and then stacked one on another to form a circular disk. In either case a plate about one inch thick and of a preselected dimeter is built up. The individual fibers run through the plate from front to back. At this point the plate is somewhat weak from a structural standpoint and a steel ring or collar is placed around the perimeter of the plate to provide compression and structural stability during the epoxy curing step.

Generally, the composite is placed in a conventional autoclave and cured at a temperature of about 350° F. and 70 psi for several hours. The exact time sequence, temperature and pressure can be varied as desired, depending on the size and makeup of the plate 18. For greater strength, the face plate is generally spherical rather than flat.

After the curing cycle is completed, the face plate 18 is removed from the autoclave, cleaned off and the edges machined after removing the compression clamp. Both the rear and front surfaces are also cleaned and polished so that the ends of the boron fiber, 20 are not covered by epoxy. This can be accomplished by grinding or the use of a conventional etching procedure. Both surfaces must be reasonably smooth.

A thick steel ring 24 is then positioned around the circumference of the plate 18 for structural strength. The ring 24 can be heated to shrink fit the ring or, it can be made in pieces and then bolted on. Any gaps remaining at the closure points are filled and sealed with epoxy which is also used to adhesively affix the face plate 18 to the envelope 10.

The boron fibers 20 are positioned in parallel relationship to each other with their individual longitudinal axes being coincident to the longitudinal axis of the cathode ray tube 10 allowing the electrical signal 14 to be transmitted through the fibers with a high degree of resolution.

With the faceplate 18 mounted on the envelope 10, the electron beam 14 strikes the inside surface of plate 18. The resolution is excellent since the fibers 20 are small and closely packed. The signal 14, coming from the gun 12 through the boron fibers 20, is picked up by means of an external conventional recording media or device 22. For example, Display Systems Engineering by Luxenberg and Kuehn, McGraw Hill, 1968, discloses a number of media suitable for recording the information represented by signal 14. A suitable method, for example, would be to use an oil layer on the face plate or some other control layer. The electrical charge from the fibers causes the oil to mound up and have depressions. The oil, with depressions, can then be photographed to give the desired information.

While the invention has been described with particularity in reference to a specific embodiment thereof, it is to be understood that the disclosure of the present invention is for the purpose of illustration only and is not intended to limit the invention in any way, the scope of which is defined by the appended claim.

What is claimed is:

1. In a cathode ray tube having an elongated envelope, an electron gun positioned within said envelope at one end thereof, a face plate adhesively affixed to the other end of said envelope to form an evacuated enclosure, the improvement which comprises a faceplate composed substantially of a plurality of closely packed, electrically conducting boron fibers, each of which consists essentially of a central core of tungsten boride surrounded by a boron sheath, said fibers being positioned in parallel relationship to one another and in which the longitudinal axis of each fiber is coincident to the longitudinal axis of said elongated envelope.

2. A cathode ray tube in accordance with claim 1 wherein said boron fibers are embedded within a synthetic resin matrix.

3. A cathode ray tube in accordance with claim 2 wherein said boron fibers are embedded within an epoxy resin matrix.

4. In a cathode ray tube having an elongated envelope, an electron gun positioned within said envelope at one end thereof, a face plate adhesively affixed to the other end of said envelope to form an evacuated enclosure, the improvement which comprises a face plate consisting of a plurality of closely packed, electrically conducting fibers composed of a tungsten boride central core surrounded by a boron sheath, said fibers being embedded within a synthetic resin matrix in parallel relationship to one another and in which the longitudinal axis of each fiber is coincident to the longitudinal axis of said elongated envelope.

* * * * *